US005465506A

United States Patent [19]

Matis et al.

[11] Patent Number: 5,465,506

[45] Date of Patent: Nov. 14, 1995

[54] SANDAL FASTENING SYSTEM

[75] Inventors: Clark A. Matis, Shelburne; Michael S. Garman, Burlington, both of Vt.

[73] Assignee: Karhu USA Inc., South Burlington, Vt.

[21] Appl. No.: 184,007

[22] Filed: Jan. 19, 1994

[51] Int. Cl.[6] ..... A43B 3/12; A43B 11/00

[52] U.S. Cl. ..... 36/11.5; 36/50.1

[58] Field of Search ..... 36/11.5, 50.1, 36/50.5, 69, 7.5; 441/106, 108

[56] References Cited

U.S. PATENT DOCUMENTS

| | | | |
|---|---|---|---|
| Des. 318,170 | 7/1991 | Hatfield . | |
| Des. 321,977 | 12/1991 | Kilgore et al. . | |
| Des. 322,511 | 12/1991 | Lucas . | |
| Des. 324,941 | 3/1992 | Hatfield . | |
| Des. 325,290 | 4/1992 | Hatfield . | |
| Des. 330,971 | 11/1992 | Hatfield . | |
| Des. 335,207 | 5/1993 | Lucas . | |
| Des. 337,423 | 7/1993 | Bailey . | |
| Des. 341,701 | 11/1993 | McDonald . | |
| 950,862 | 3/1910 | Nelson . | |
| 1,652,354 | 12/1927 | Grubs . | |
| 1,964,406 | 6/1934 | Pellkofer | 36/11.5 |
| 2,099,418 | 11/1937 | Bradley et al. | 36/11.5 |
| 2,377,119 | 5/1945 | Amenta . | |
| 2,451,372 | 10/1948 | Ballenger . | |
| 2,642,677 | 6/1953 | Yates . | |
| 2,894,338 | 7/1959 | Scholl | 36/11.5 |
| 3,323,233 | 6/1967 | Scholl . | |
| 3,452,457 | 7/1969 | Jones et al. . | |
| 3,739,501 | 6/1973 | Barrett, Jr. | 36/11.5 |
| 4,079,527 | 3/1978 | Antonious . | |
| 4,130,949 | 12/1978 | Seidel | 36/50.1 |
| 4,275,512 | 6/1981 | Zeligman et al. . | |
| 4,626,221 | 12/1986 | Rocco | 441/108 |
| 4,677,767 | 7/1987 | Darby . | |
| 4,793,075 | 12/1988 | Thatcher . | |
| 4,839,948 | 6/1989 | Boros | 36/50.1 |
| 4,972,613 | 11/1990 | Loveder | 36/50.1 |
| 5,012,597 | 5/1991 | Thomasson . | |
| 5,020,941 | 6/1991 | Birin et al. | 441/111 |
| 5,056,241 | 10/1991 | Young . | |
| 5,117,568 | 6/1992 | Mitsui . | |
| 5,226,246 | 7/1993 | Soo . | |

FOREIGN PATENT DOCUMENTS

| | | | |
|---|---|---|---|
| 1052996 | 4/1979 | Canada . | |
| 1056153 | 6/1979 | Canada . | |
| 1108394 | 9/1981 | Canada . | |
| 1153548 | 9/1983 | Canada . | |
| 1156830 | 11/1983 | Canada . | |
| 1161248 | 1/1984 | Canada . | |
| 1162737 | 2/1984 | Canada . | |
| 1186144 | 4/1985 | Canada . | |
| 1197377 | 12/1985 | Canada . | |
| 1204932 | 5/1986 | Canada . | |
| 1218455 | 7/1987 | Canada . | |
| 69308 | 10/1991 | Canada . | |
| 73035 | 8/1993 | Canada . | |
| 73034 | 8/1993 | Canada . | |
| 349631 | 8/1937 | Italy . | |
| 77921 | 3/1918 | Switzerland . | |
| 3306396 | 8/1984 | United Kingdom | 36/50.1 |

*Primary Examiner*—Steven N. Meyers
*Attorney, Agent, or Firm*—Fay, Sharpe, Beall, Fagan, Minnich & McKee

[57] ABSTRACT

A strap system which includes a strap (such as an instep strap) and a buckle. The buckle is engageable with the strap such that the strap defines an adjustable strap loop. The buckle is configured so that the size of the strap loop may be adjusted so as to vary the snugness of the strap system to the foot.

7 Claims, 10 Drawing Sheets

FIG. 4
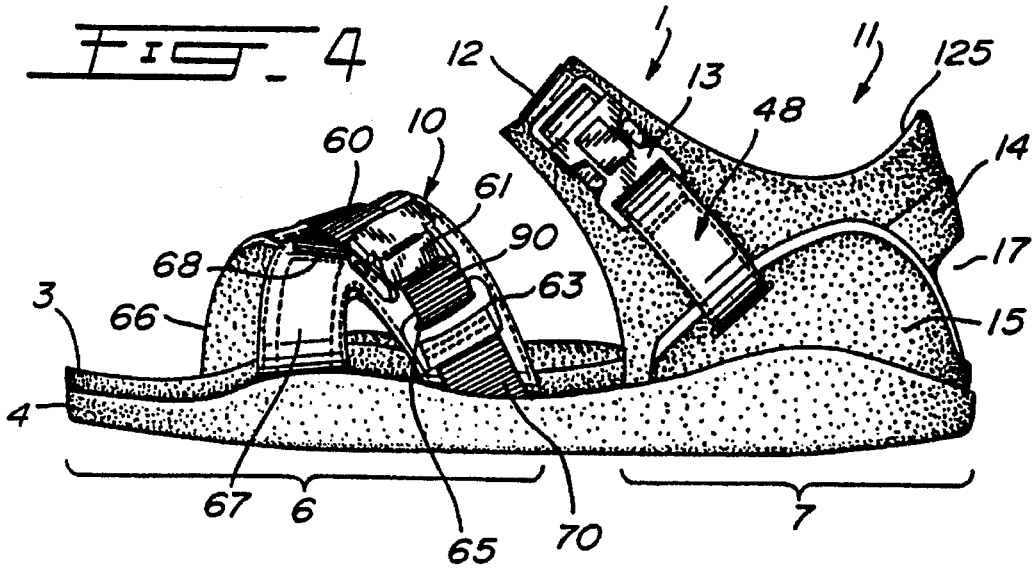
FIG. 5
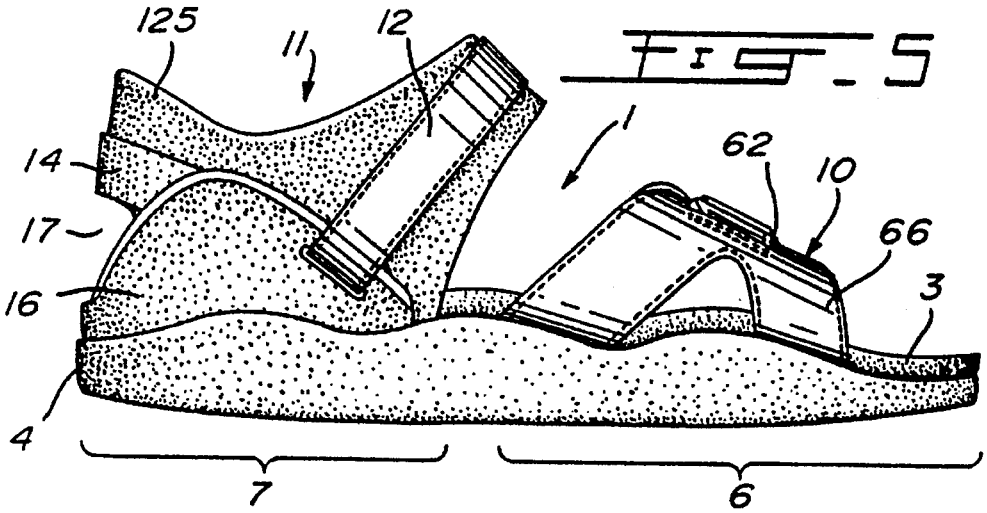
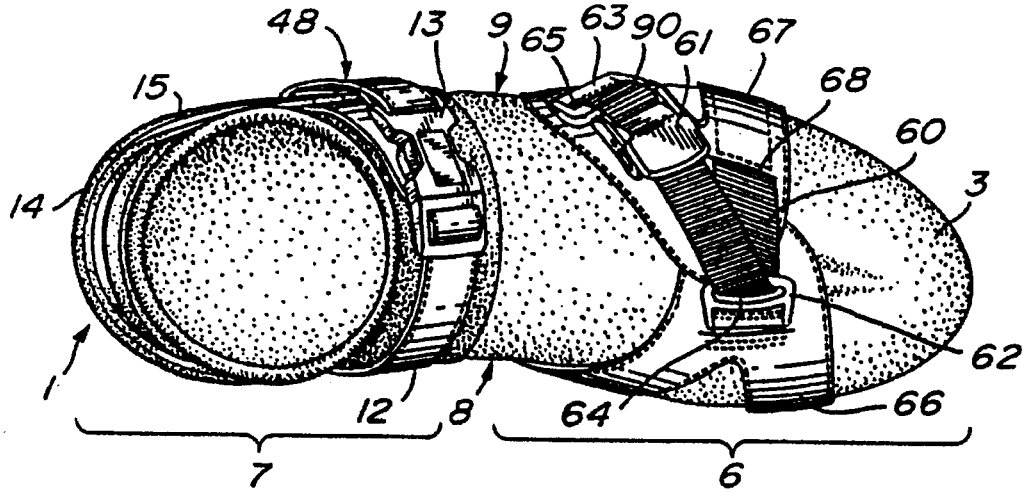
FIG. 6

SANDAL FASTENING SYSTEM

The present invention relates to a sandal construction and in particular sandals intended to be used with bare feet.

The invention in particular is directed to a sandal construction having an adjustable, quick release strapping system, e.g. an adjustable, quick release rear strap system, an adjustable, quick release instep strap system, an adjustable, quick release front strap system or a combination thereof.

SUMMARY OF INVENTION

The present invention generally relates to a sandal of the type comprising a sole and a strap system for retaining the sole on a human foot. Such strap systems may comprise a front strap unit for securing the sandal to the front (e.g. ball) part of a human foot and a rear strap unit for securing the sandal to the rear part of the human foot.

The sandal of the present invention may generally be characterized in that the strap system comprises a strap (e.g. instep strap) and buckle means, wherein the buckle means is engageable with the strap such that the strap defines an adjustable strap loop, and wherein the buckle means is configured so that the size of the strap loop may be adjusted so as to vary the snugness of the strap system to the foot.

The present invention, in particular, provides a sandal of the type comprising a sole and a strap system for retaining said sole on a human foot, said human foot having a front part and a rear part, said sole having a front portion, a heel portion, and, opposed first and second side edges, said strap system comprising a front strap unit for securing the sandal to the front part of the human foot and an ankle strap unit for securing the sandal to the rear part of the human foot, characterized in that at least one of said strap units comprises a strap a strap fastener, and a strap connector comprising an opening for receiving said strap, said strap connector being attached to said first side edge of said sole, said strap fastener comprising first and second locking parts, said first and second locking parts being configured so as to be releasably interlockable, said first locking part comprising a ladder lock member, said ladder lock member comprising at least openings for receiving said strap, said strap being attached to said second side edge of said sole and being threaded, in serpentine fashion, through at least two openings of said ladder lock member, said strap being attached to said second locking part and being threaded through the opening of said strap connector such that when the first and second locking parts are interlocked, the strap defines a strap loop threaded through the opening of said strap connector, said strap being configured so as to be threadable through said opening of the strap connector when the first and second locking parts are separated, said at least two openings of said ladder lock member being configured and disposed such that when the first and second locking parts are interlocked and the strap loop is longitudinally tensioned, the ladder lock member grasps the strap so as to secure the strap fastener to the strap and such that when the first and second locking parts are separated, the strap is threadable through said at least two openings of the ladder lock member for varying the size of said strap loop so as to thereby adjust the grasp of the strap to the foot, i.e. the firmness or snugness of the strap, varies in accordance with the size of the loop which may be adjusted when the locking parts are separated.

In accordance with the present invention, the above mentioned strap associated with the above described strap fastener and strap connector may be a front strap for the front of the foot, an instep strap for the instep of the foot, a rear strap for the rear of the foot (i.e. the achilles tendon area or heel area of the foot); the sandal may comprise a combination of such adjustable straps.

Thus, the ankle strap unit may comprise an instep strap for grasping the instep of the foot. In this case, in accordance with the present invention the ankle strap unit may comprise an instep strap, an above described strap connector for said instep strap and an above described strap fastener for said instep strap.

More particularly, the present invention provides a sandal of the type comprising a sole and a strap system for retaining said sole on a human foot, said human foot having a front part and a rear part, said sole having a front portion, a heel portion, and, opposed first and second side edges, said strap system comprising a front strap unit for securing the sandal to the front part of the human foot and an ankle strap unit for securing the sandal to the rear part of the human foot, characterized in that said ankle strap unit comprises a strap, a strap fastener and a strap connector comprising an opening configured to receive said strap, said strap connector being attached to said first side edge of said sole at said heel portion, said strap fastener comprising first and second locking parts, said first locking and second locking parts being configured so as to be releasably interlockable, said first locking part comprising a ladder lock member, said ladder lock member comprising at least two openings for receiving said strap, said strap being attached to said second side edge of said sole at said heel portion and being threaded, in serpentine fashion, through at least two openings of said ladder lock member, said strap being attached to said second locking part and being threaded through the opening of said strap connector such that when the first and second locking parts are interlocked, the strap defines a strap loop threaded through the opening of said strap connector, said strap being configured so as to be threadable through said opening of the strap connector when the first and second locking parts are separated, said at least two openings of said ladder lock member being configured and disposed such that when the first and second locking parts are interlocked and the strap loop is longitudinally tensioned, the ladder lock member grasps the strap so as to secure the strap fastener to the strap and such that when the first and second locking parts are separated, the strap is threadable through said at least two openings of the ladder lock member for varying the size of said strap loop so as to thereby adjust the grasp of the strap to the foot.

In accordance with the present invention, the ankle strap unit may also include a rear, heel engaging retaining element. The heel engaging element may comprise a heel counter which extends all around the heel region; the heel engaging element may comprise a rear strap which may be connected to the sole in known manner such as for example as shown in U.S. Pat. No. 4,793,075 the entire contents of which are herein incorporated by reference.

Thus, the ankle strap unit may comprise a rear strap. In this case, the ankle strap unit may be configured such that said instep and rear straps are operable to respectively grasp the instep and the rear heel part of the foot, e.g. encircle a user's ankle area when the sandal is in use; the instep strap and rear straps may for example be connected to the rear part of the sole as illustrated in the above mentioned U.S. Pat. No. 4,793,075.

In accordance with the present invention, the ankle strap unit may, if desired, include a rear strap and heel counter means wherein the heel counter means comprises opposed first and second upstanding heel counter members attached to the sole at said rear heel portion. The first heel counter member may be attached at said first side edge of the sole, while the second heel counter member may be attached at said second side edge of the sole. The first heel counter member may define said strap connector means and said opening thereof for receiving said instep strap. The rear strap may be attached to each of said heel counter members. The instep strap may be threaded through the opening of said so defined strap connector means and being attached to the second heel counter member.

As mentioned above, in accordance with the present invention, the strap system may comprise a front strap unit which extends transversely across the front (e.g. the ball) portion of the human foot for securing the sandal to the front part of the human foot. The front strap unit may comprise a strap, strap fastener, strap connector means as defined above or the front strap unit may take on any other configuration; the front strap unit may, for example, take on a configuration such as illustrated in the previously mentioned U.S. patent.

In general in accordance with the present invention, the front strap unit may be configured to extend transversely across the front (e.g. the ball) portion of the human foot and may comprise a strap and buckle means, said buckle means being engageable with said flexible strap such that said flexible strap defines a second adjustable strap loop, said buckle being configured so that the size of said second strap loop may be adjusted so as to vary the snugness of the front fastener; the front strap unit may for example be a cross-over strapping unit.

In accordance with the present invention, the front strap unit may comprise first connector means, second connector means, a front strap, and a clamp fastener; said clamp fastener may comprise a first clamp element and displaceable clamp means connected to lever means.

The first connector means may be attached to the first side edge of said sole at said front portion while the second connector means may be attached to said second side edge of said sole at said front portion. The first connector means and the second connector means both comprise an opening configured to receive the front strap.

The clamp fastener may be configured to clampingly engage the front strap between the first clamp element and the displaceable clamp means such that a part of the front strap extends from one side of the clamp fastener and another part of the front strap extends from another side of said clamp fastener. The part of the front strap extending from one side of the clamp fastener is threaded through the opening of the second connector means and is attached to the clamp fastener so as to define a first strap loop. The part of the front strap extending from said another side of the clamp fastener is threaded through the opening of said first ring connector means and is attached adjacent to said second side edge of the sole so as to define a V-shape strap configuration having an apex located at the first connector means.

The clamp means and said lever means may be configured such that the displaceable clamp means is displaceable by the lever means between an operative position and non-operative position, namely:

an operative position wherein the front strap is clamped between said displaceable clamp means and said first clamp element so as to secure the clamp fastener to the front strap and a non-operative position wherein the clamp fastener is released from the front strap for adjusting the size of said first strap loop and the length of said part of the front strap defining the V-shaped strap configuration so as to thereby adjust the grasp of the first fastener to the foot, i.e. the firmness or snugness of the front strap, when the displaceable clamp means is in said operative position, varies in accordance with the size of the loop and the length of the V-shape which is adjusted when the displaceable clamp means is in the non-operative position.

In accordance with the present invention, the sandal sole may comprise an insole and an outsole, the heel counter members if present, being attached to the sole at the periphery of the outsole, said heel counter members each having an inner concave-like surface and an outer convex-like surface.

The front strap is configured so as to be threadable through the openings of said first and second connector means when the clamp fastener is released from the front strap.

The strap system of the present invention avoids the presence of loose strap ends (as may be present with a Velcro type fastener system) which if present may be caught up by objects such as tree branches etc. and cause the strap(s) to be undesirably loosened with the attendant possibility of the sandal falling away from the foot.

In drawings which illustrate example embodiments of the present invention,

FIG. 4 is a side view of the outside or second side of the sandal of FIG. 1;

FIG. 5 is a side view of the inside or first side of the sandal of FIG. 1;

FIG. 6 is a top view of the sandal of FIG. 1;

Figure 1:
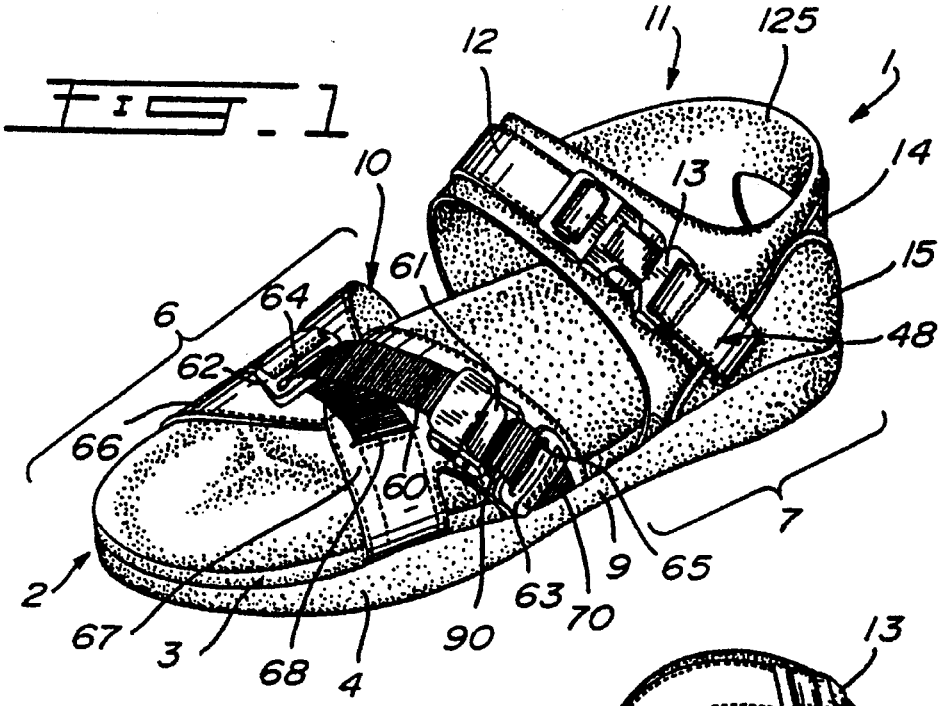
FIG. 1 is top side perspective view of an example embodiment of a sandal in accordance with the present invention having rear and front strap units.
Figure 2:
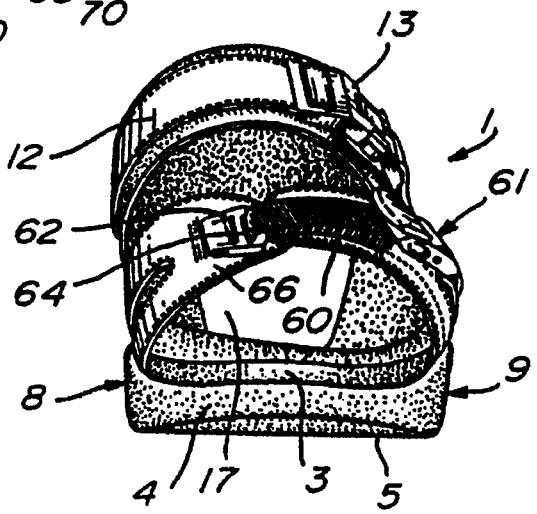
FIG. 2 is a front view of the sandal of FIG. 1.
Figure 3:
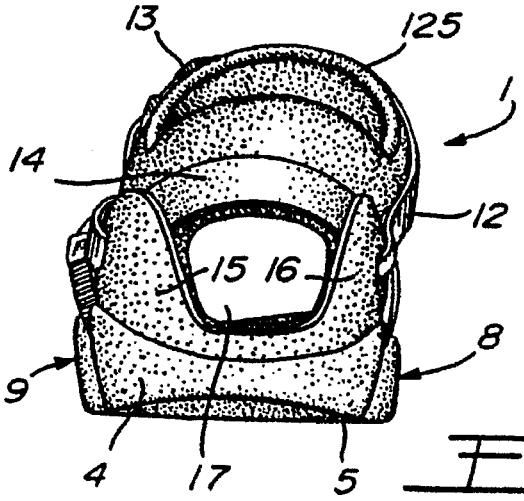
FIG. 3 is a rear view of the sandal of FIG. 1.
Figure 9:
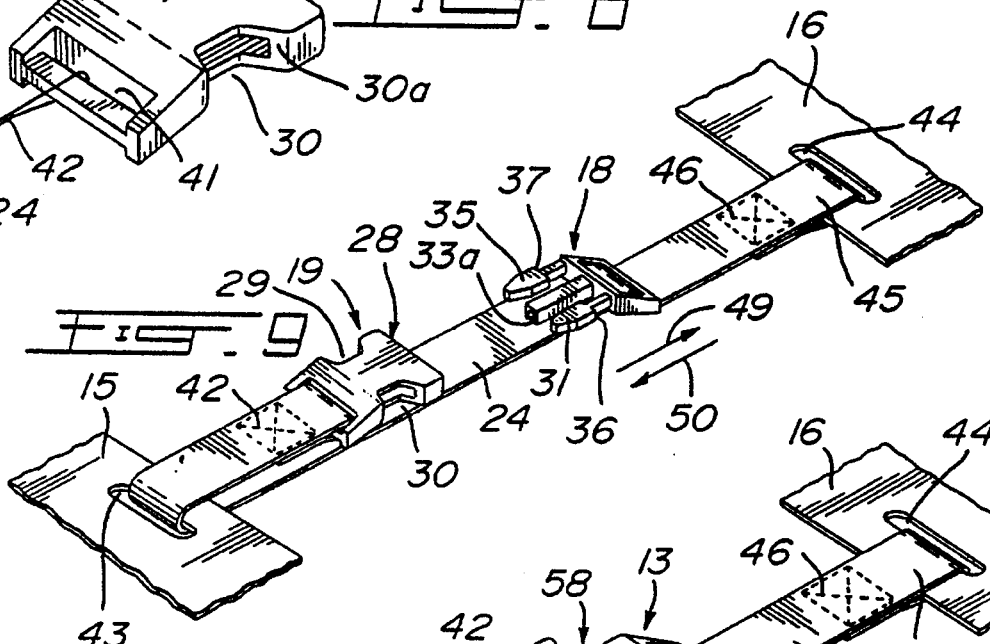
Figure 10:
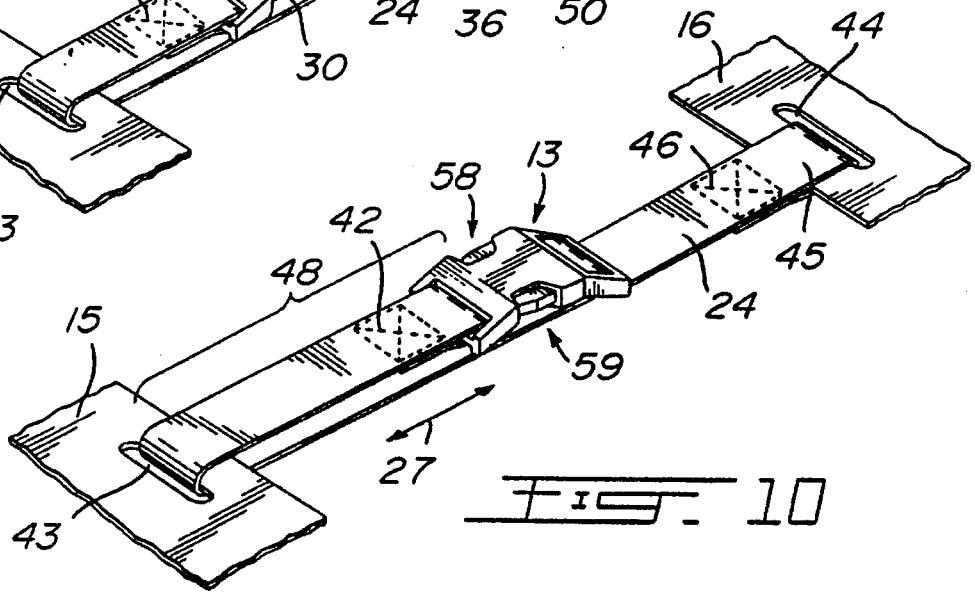
Figure 11:
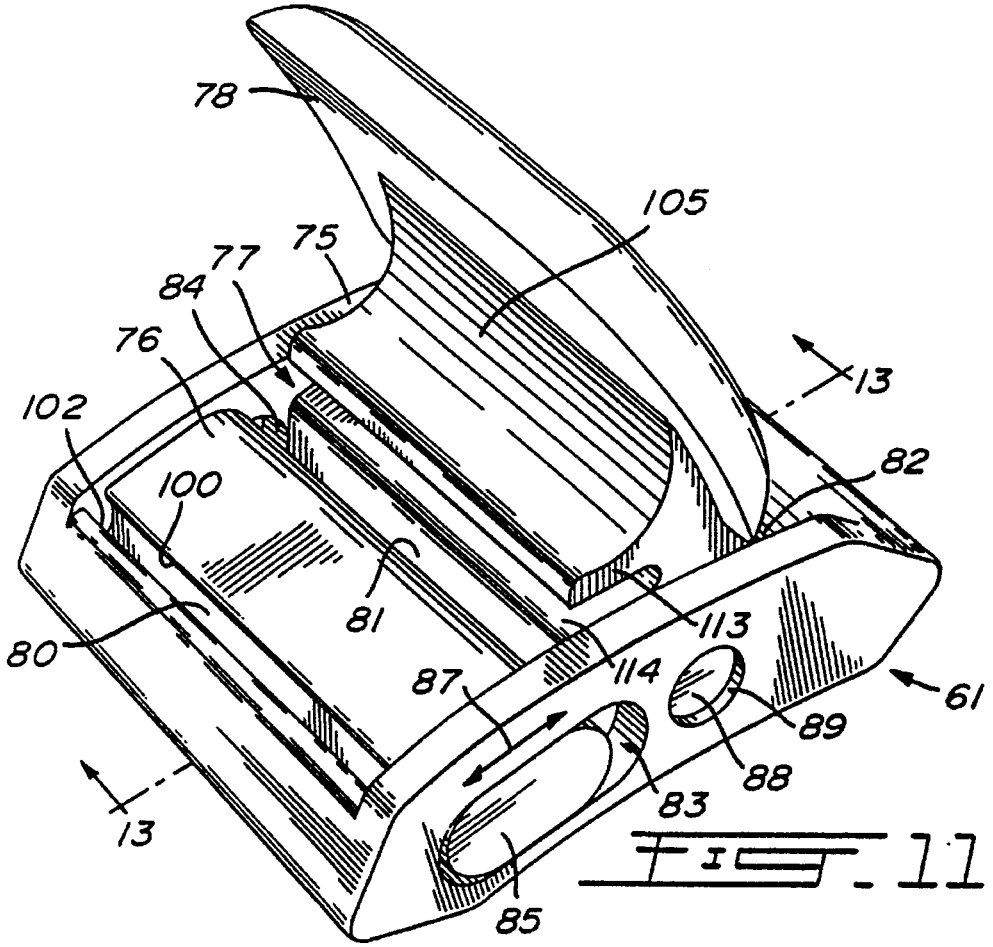
Figure 12:
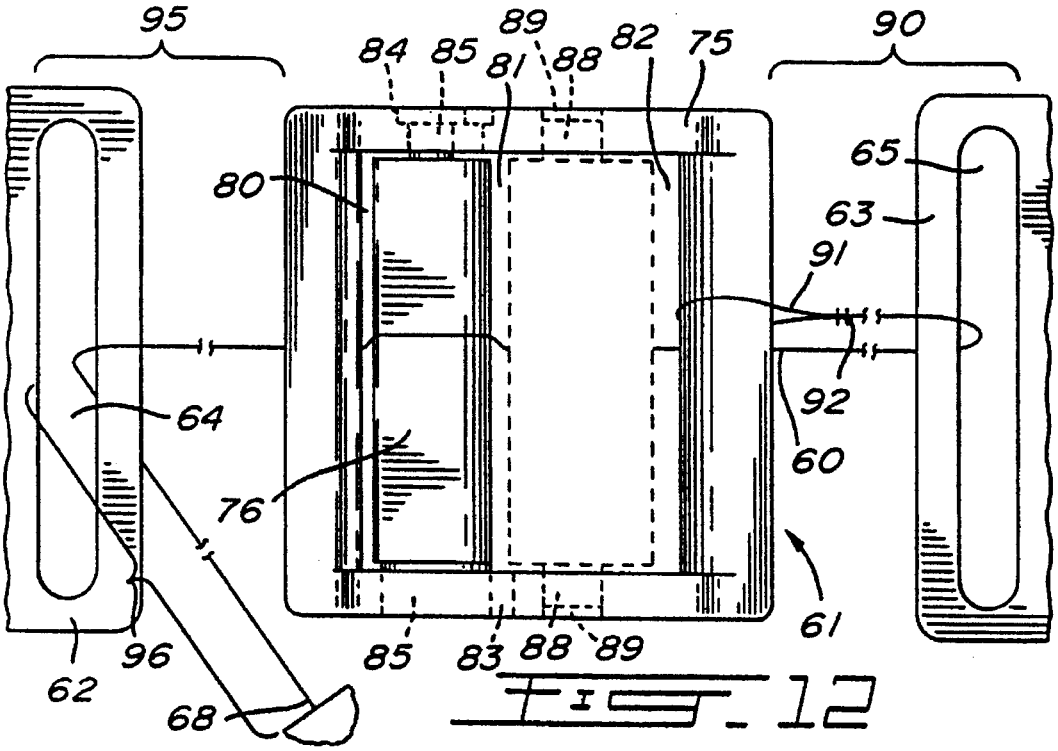
Figure 13:
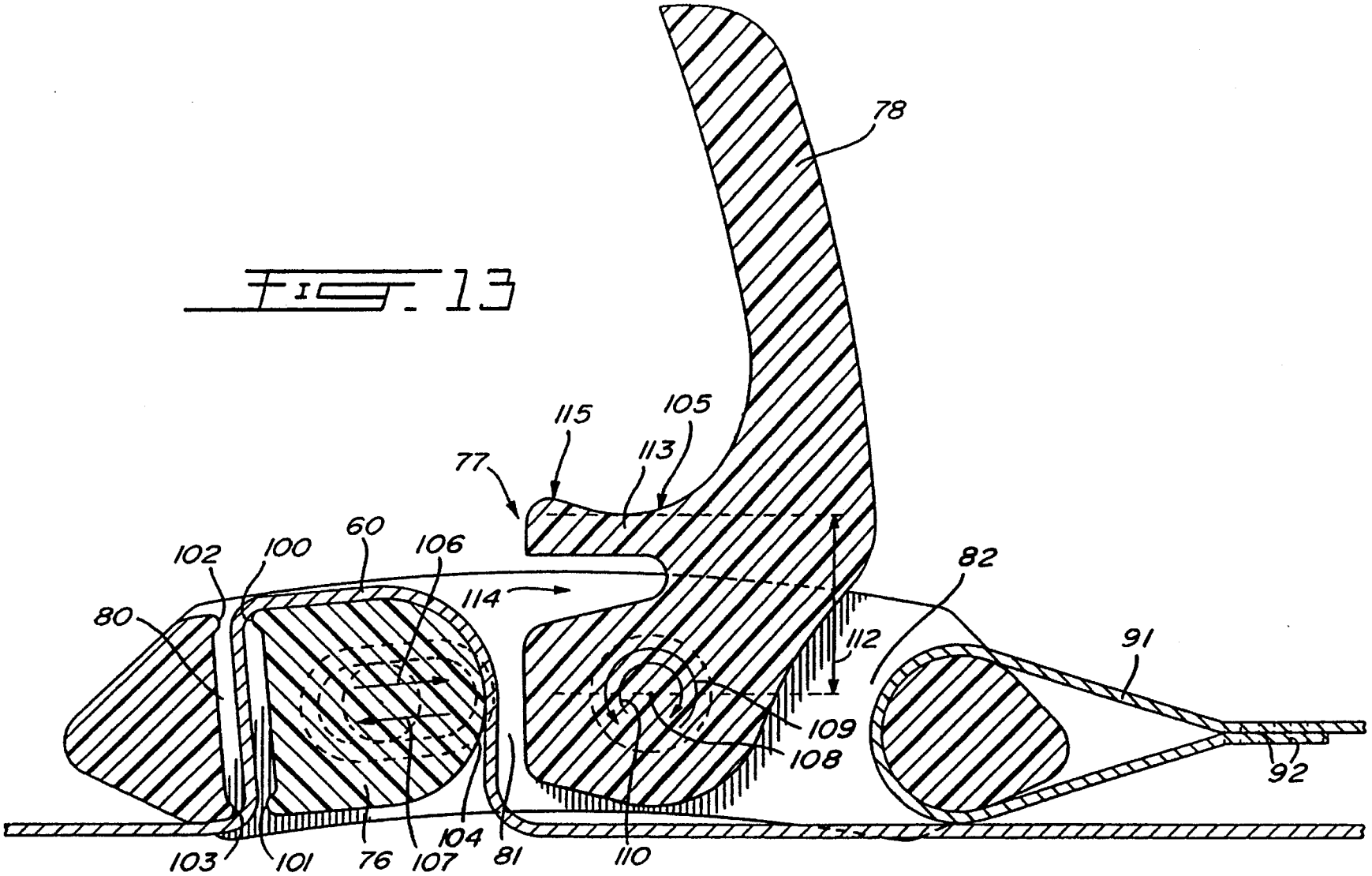
Figure 14:
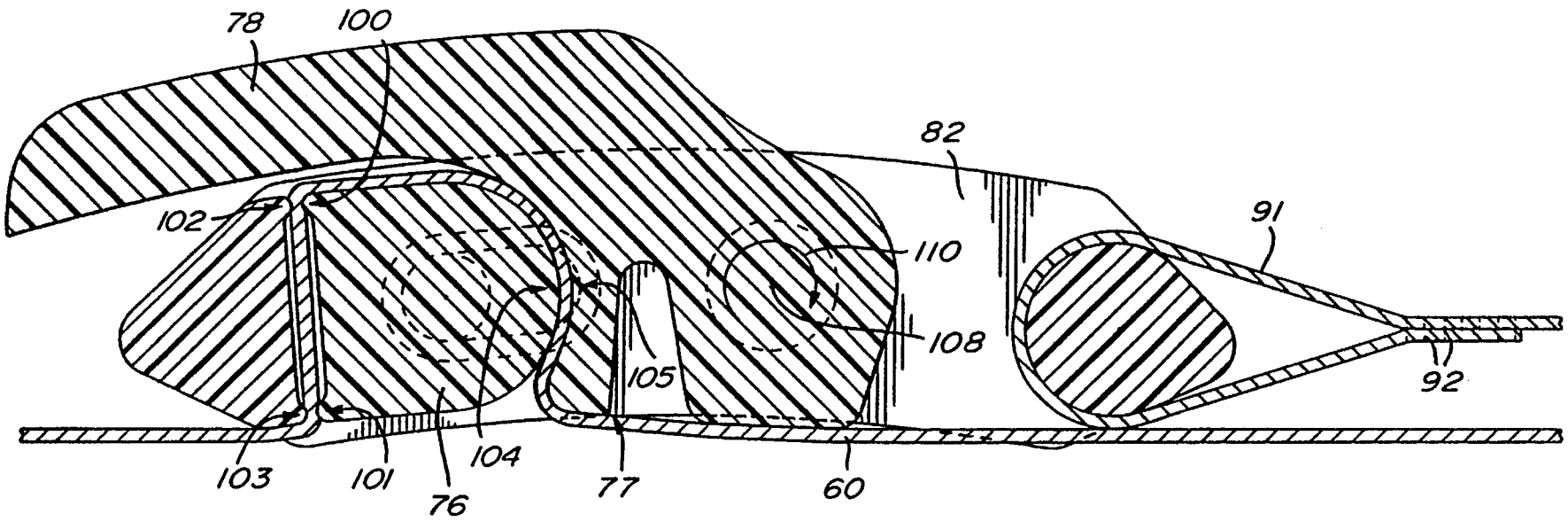
Figure 15:
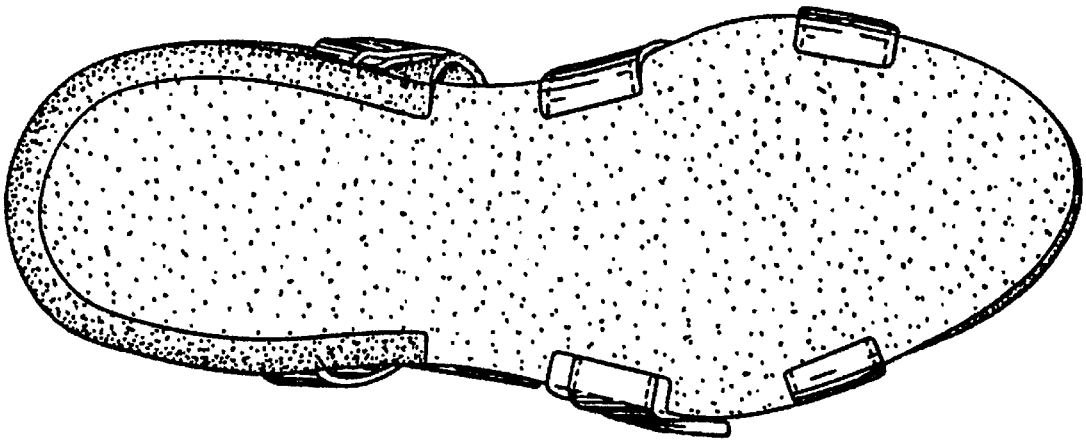
Figure 16:
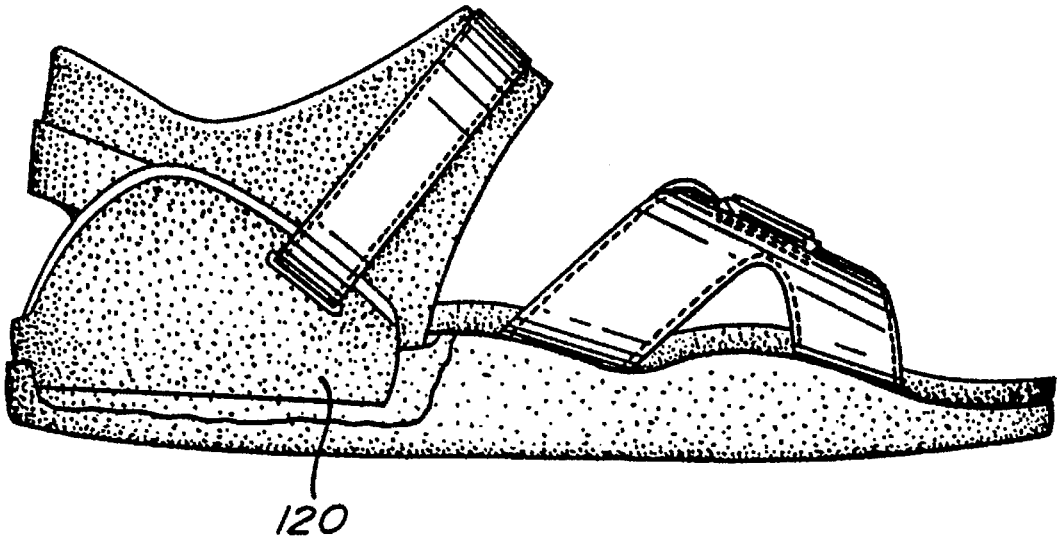
Figure 17:
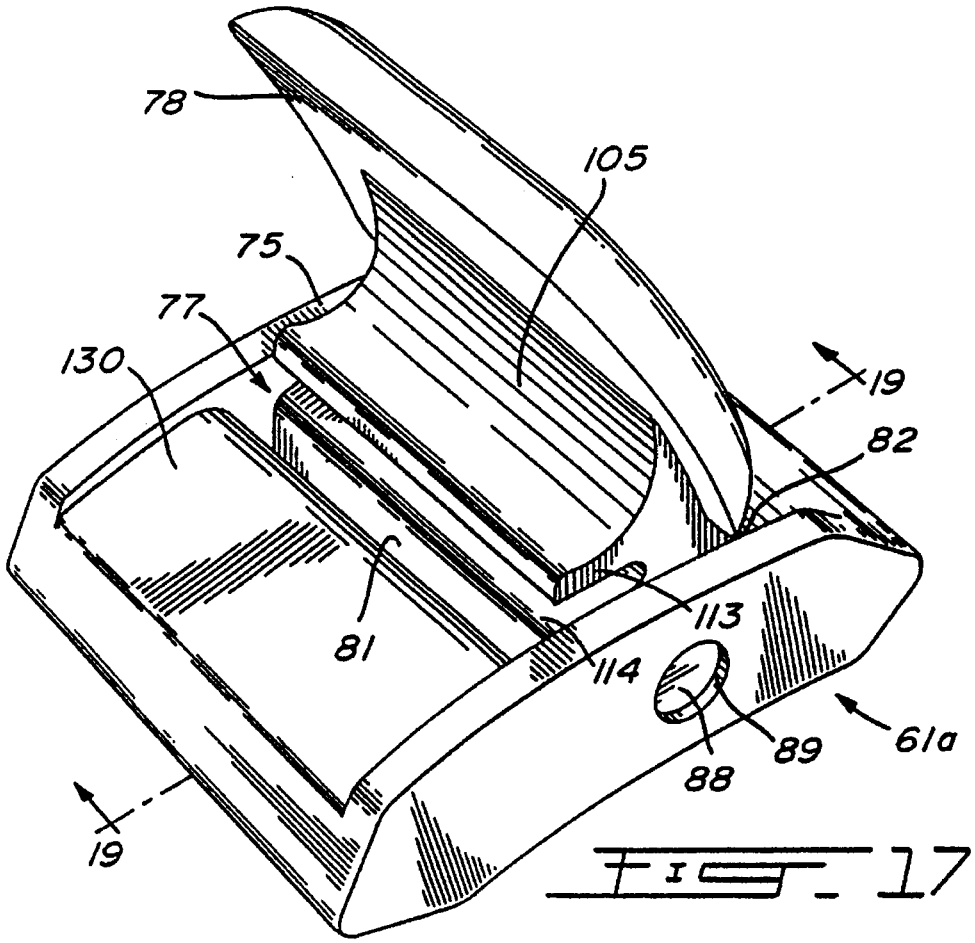
Figure 18:
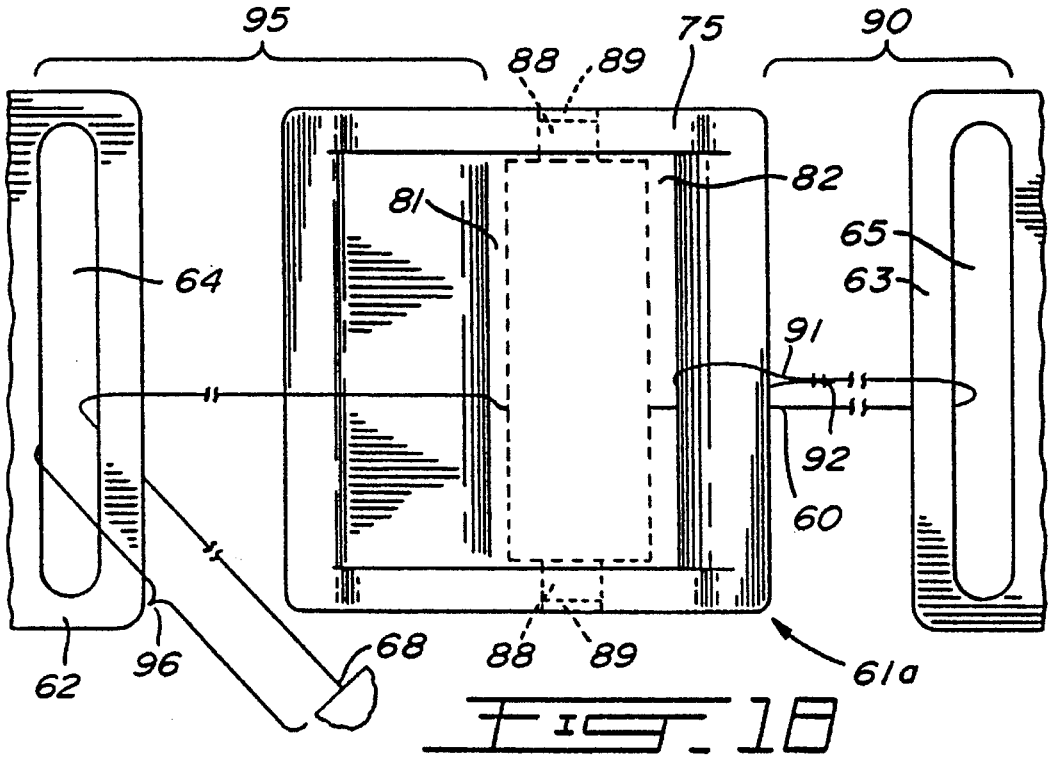
Figure 19:
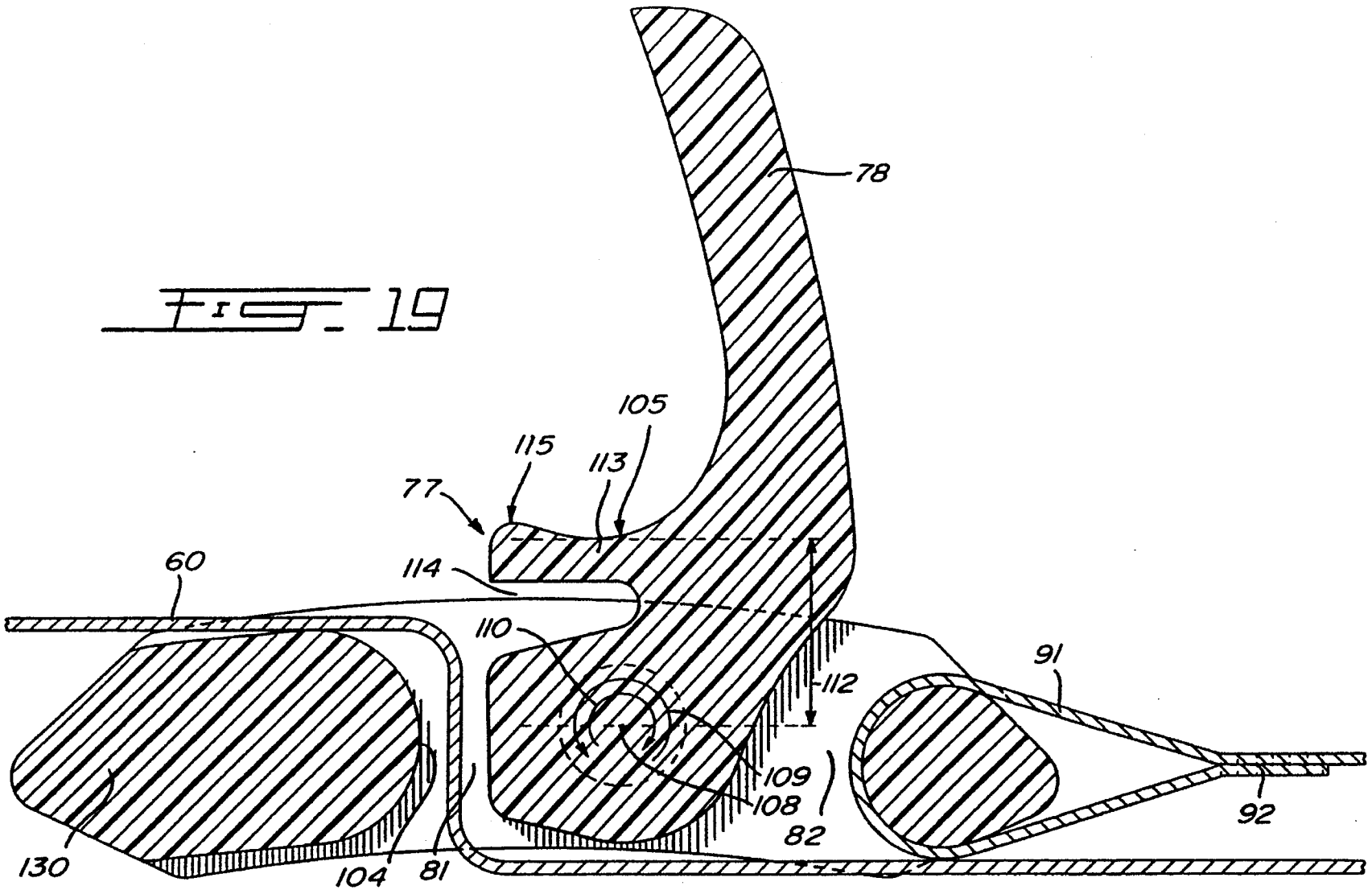
Figure 20:
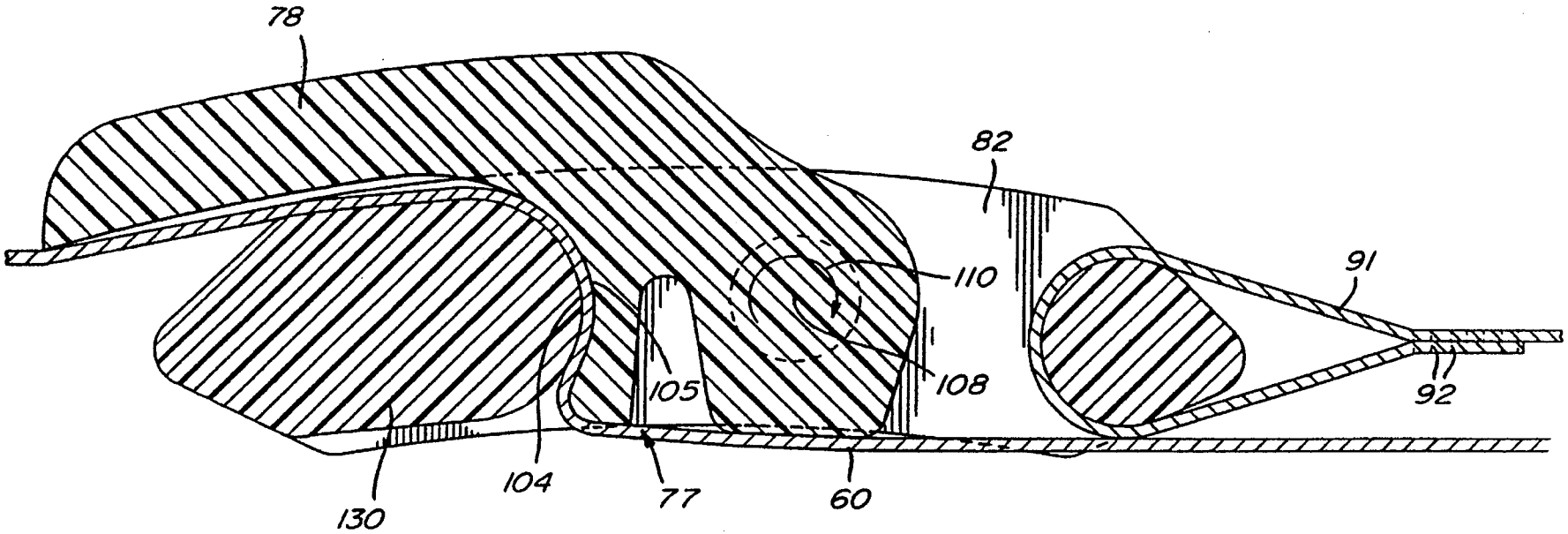

FIG. 9 schematically illustrates an ankle strap fastener shown in FIG. 1, the first and second locking parts being shown separated so as to allow adjustment of the position of the ladder locking member on the instep strap for adjusting the grip of the instep strap on the foot;

FIG. 10 schematically illustrates the ankle strap fastener shown in FIG. 9 wherein the first and second locking parts are interlocked such that the instep strap may grip the foot;

FIG. 11 is a top perspective view of an example clamp fastener of the front clamp fastener shown in FIG. 1;

FIG. 12 schematically illustrates the disposition of the front strap relative to the clamp fastener and the first and second connector means of the front fastener as shown in FIG. 1;

FIG. 13 is a section along 13—13 of FIG. 12 with the instep strap being threaded between the clamp means and the displaceable clamp means, the displaceable clamp means being in a non-operative position;

FIG. 14 is a section along 13—13 of FIG. 12 with the instep strap being threaded through the clamp fastener but with the displaceable clamp means being in an operative position;

FIG. 15 is a bottom view of the sandal of FIG. 1 with the outsole removed to show the underside of the insole;

FIG. 16 is a partially cutaway side view of the sandal of FIG. 1;

FIG. 17 is a top perspective view of a modified version of the example clamp fastener of the front clamp fastener shown in FIG. 1;

FIG. 18 schematically illustrates the disposition of the front strap relative to the modified clamp fastener of FIG. 17 and the first and second connector means of the front fastener as shown in FIG. 1;

FIG. 19 is a section along 19—19 of the FIG. 17 with the instep strap being threaded between the clamp means and the displaceable clamp means, the displaceable clamp means being in a non-operative position;

FIG. 20 is a section along 19—19 of FIG. 17 with the instep strap being threaded through the clamp fastener but with the displaceable clamp means being in an operative position.

DETAILED DESCRIPTION OF THE PREFERRED EMBODIMENT.

With respect to the figures the same reference numeral will be used in each of the figures with respect to the same element.

Referring to FIGS. 1 to 6, these figures show a sandal intended to be worn on the left foot of a user; the corresponding sandal for the right foot may of course be the mirror image of that for the left foot.

The samdal 1 shown has a sole 2 which includes an upper sole (or insole) 3 and a lower sole (or outsole) 4; the sole 2 is configured to more or less match the contour of a users foot. The insole 3 is configured to provide user comfort whereas the outsole 4 is configured for wear and traction; the bottom surface 5 of the sole 2 may thus have a roughened tire tread like aspect to enhance traction of the sole with respect to the ground.

The sole 2 has a front portion 6 and a rear portion 7 as well as opposed first and second side edges designated generally by the reference numerals 8 and 9 respectively; for the sole as shown, the first side edge 8 is the inside side edge of the sole while the second side edge 9 is the outside side edge of the sole; the inside edge 8 will face the corresponding inside edge of the right foot sandal worn by the user.

A front strap unit 10 is mounted to the front portion 6; for this example, the front strap unit 10 is mounted so as to grasp the ball area of the users foot.

A rear heel basket 11 is mounted at the rear portion 7 of the sandal 2. The rear basket 11 comprises an ankle strap unit for grasping the rear part of the users foot, i.e. grasping the instep and rear part of the foot at the heel or achilles tendon. The ankle strap unit includes an instep strap 12 and a strap fastener 13; the ankle strap unit also includes a rear strap 14.

The rear heel basket 11 includes two opposed upstanding heel counter members 15 and 16. The heel counter members 15 and 16 are spaced apart by opening 17. The heel counter members 15 and 16 are each configured to have a concave inner surface and a convex outer surface such that the counter members 15 and 16 are configured to follow the contour of the sides of the heel part of a users foot; the curved aspect of the counter members provides them with stiffness for enhancing lateral stability or support. The rear strap 14 is fixed to heel counter members 15 and 16, i.e. it is not of adjustable length; if desired, however, it may be configured to be of adjustable length in like manner such as discussed below for the instep strap part of the ankle strap unit.

Turning to FIGS. 7 to 10 these figures show in greater detail the structure of the instep part of the ankle strap unit.

Figure 7:
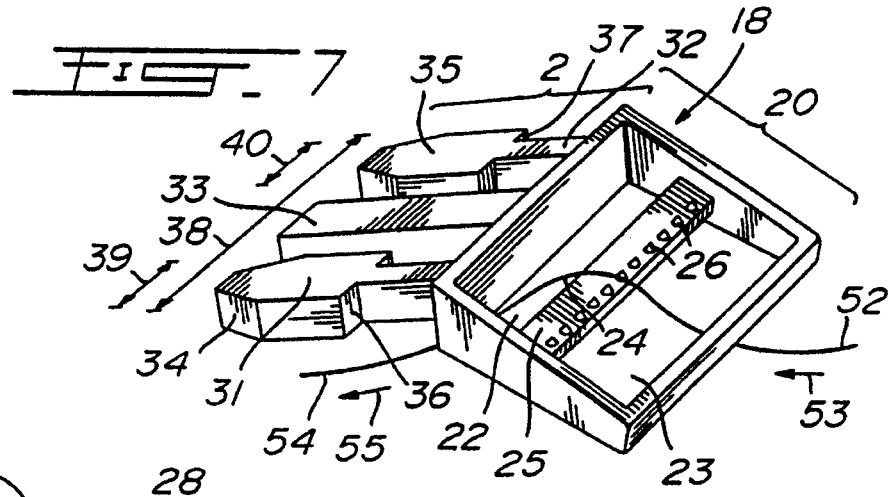
FIG. 7 is a top perspective view of an example embodiment of a ladder locking member of the first locking part of the strap fastener shown in FIG. 1.
Figure 8:
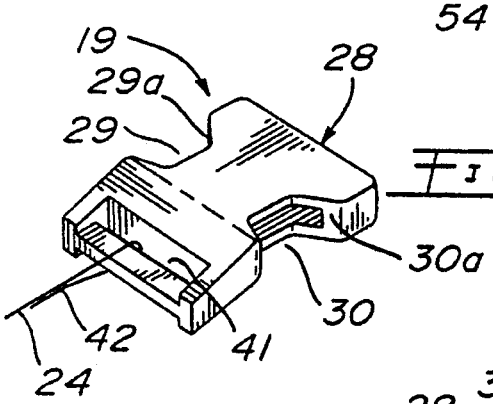
FIG. 8 is a top perspective view of an example embodiment of a second locking part of the strap fastener shown in FIG. 1, mateable with the first locking part shown in FIG. 7.

As mentioned above the ankle strap unit comprises a strap fastener 13. The strap fastener comprises first and second locking parts which are configured to be releasably interlockable. FIG. 7 illustrates the first locking part 18 while FIG. 8 shows the second locking part 19; this type of fastener is known.

Referring to FIG. 7 the first locking part 18 has a ladder lock part 20 and a male part 21. The ladder lock part 20 has two opening 22 and 23 configured to receive an instep strap designated by the reference numeral 62; the instep strap is shown for illustration purposes in FIG. 7 only as a line. Although the ladder lock part 20 is shown with two openings it could of course have three or more such openings as desired; any additional openings will however complicate the threading of the strap 12 therethrough. As may be seen in FIG. 7 the instep strap is threaded in serpentine fashion through the openings 22 and 23 about a separator member 25. The separator member 25 is provided with detent means in the form of a plurality of spaced apart sharp projections, two of which are designated with the reference numeral 26. The detent means is engageable with the instep strap for inhibiting slippage of the strap through the openings 22 and 23; the projections 26 serve to bite into the instep strap 12 when the strap is pulled tight up against the separator member 25 and thus enhance the gripping power of the ladder lock part 20 when the instep strap 12 is longitudinally tensioned in the direction of the arrow 27 shown in FIG. 10.

The first locking part 18 also has a male part 21. This part 21 is configured to lockingly but releasably mate with the second locking part 19. Thus the second locking part 19 is provided with a main opening configured and sized to receive the male part 21, through a mouth located generally as designated by the reference numeral 28. The side wall of the second locking part 19 which defines the main opening for receiving the male part 21 is also provided with wing openings 29 and 30 and abutment surfaces 29*a* and 30*a*.

Turning back to FIG. 7, the male part 21 is shown with three elements, namely two side elements 31 and 32 and a central element 33. The side elements 31 and 32 are provided with respective button head parts 34 and 35 as well as respective engagement shoulders or surfaces 36 and 37. The distance 38 between the outer surfaces of the button heads 34 and 35 is sized larger than the respective width of the main opening in the second locking part 19 for receiving the male part 21. The side elements 31 and 32 are sufficiently flexible such that the button heads may be urged towards each other and once the urging force is removed they may spring or snap back to their at rest position, i.e. the button heads 34 and 35 may be displaced in the direction of the arrows 39 and 40; FIG. 9 shows the button heads in their at rest position. The button heads each have a distal front side exterior surface which is inwardly bevelled to facilitate the introduction of the male part 21 into the main opening of locking member 19.

The side wing openings 29 and 30 as well as the abutment surfaces 29*a* and 30*a* are sized and configured such that as the male part 21 is urged into the main opening of the second locking part 19, the button heads will eventually enter the side wing openings 29 and 30 and spring or snap back to their at rest position such that the shoulders 36 and 37 will engage a respective abutment surface 29*a* and 30*a* and thereby secure the male part 21 in the main opening of the second locking part 19. In order to separate the first and second locking parts the button heads must be urged toward each other such that the shoulders and respective abutment surfaces no longer can engage each other, at which point the male part 21 may be pulled out of the main opening of the second locking part. FIGS. 9 and 10 show the first and second locking parts in a separated and interlocked position respectively.

As seen from FIG. 8 the second locking part 19 has another opening 41 through which an end of the instep strap 12 is threaded to form a small unadjustable loop, the looped end being fixed in place by stitching 42. The second locking part is also provided with a central alignment ridge (not shown) which extends the length of the main opening of the second locking part; the central ridge is sized to engage the U-shaped channel 33*a* (see FIG. 9) of the central member 33 so as to facilitate the travel of the male part into and out of the main opening of the second locking part.

FIGS. 9 and 10 are schematic illustrations showing the instep strap 12, the strap fastener and portions of the heel counter members 15 and 16 which serve to anchor the strap to the sole. The heel counter members 15 and 16 are provided with openings 43 and 44; the opening 43 is sized to slidingly receive the strap. One end of the strap 12 is attached to the counter member 16 by small unadjustable loop 45 which passes through opening 44; this small loop is of fixed size and is held in place by stitching 46. The other end of the instep strap 12 is as mentioned above similarly fixed to the second locking part 19 by a small unadjustable loop held in place by stitching 42. The instep strap 12 is also slidingly threaded through the opening 43 and through the openings 22 and 23 of the ladder lock portion 20 of the first locking part 18. Once the first and second locking parts are interconnected, then as shown in FIG. 10, an instep strap loop 48 of predetermined size or length is defined.

The length of the instep strap loop 48 may be increased by displacing the first locking portion 18 along the instep strap 12 in the direction of the arrow 49, i.e. towards the heel counter member 16; by increasing the longitudinal length of the loop 48 the grip of the instep strap on the instep of the foot may be increased. To facilitate displacement of the first locking portion 18, the first and second locking portions 18 and 19 should be separate as shown in FIG. 9. Referring to FIG. 7 the first locking portion 18 is displaced along the strap by urging (e.g. pushing on) part 52 of the strap 12 in the direction of the arrow 53 until a suitable length of strap 12 passes through opening 23 and a U-shaped portion of strap is lifted off of the separator member 25; thereafter the part 54 of the strap 12 is urged in the direction of the arrow 55 until the strap 12 again engages the separator member 25 including the projections 26. The instep strap grip can be loosened by displacing the first locking member in the direction of the arrow 50 (FIG. 9); to do this the instep strap 12 is urged through the ladder locking member 20 in the opposite direction to that needed to tighten the strap grip as discussed above.

Thus to tighten the instep strap grip on the foot the first locking part 18 is to be displaced along the instep strap 12 toward the heel counter member 16 such that the size of the instep strap loop 48 is increased; on the other hand to loosen the instep strap grip on the foot the first locking part 18 is displaced along the instep strap 12 toward the heel counter member 15 such that the size of the instep strap loop 48 is decreased.

Referring to FIG. 10 the first and second locking parts 18 and 19 are disengaged by squeezing on the button heads in the direction of the arrows 58 and 59 such that the shoulders 36 and 37 of the button heads are urged clear of the abutment surfaces 29*a* and 30*a* at which point the male portion may be pulled free of the main opening of the second locking part.

Referring to FIGS. 1 to 6, these figures show as mentioned above a front strap unit 10. The front strap unit includes a front strap 60, a clamp fastener 61, as well as first and second connector elements 62 and 63 respectively; as may be seen the connector elements 62 and 63 have openings 64 and 65 through which the front strap 60 may be slidingly threaded as shall be explained below. The front strap unit as shown also has a pair of V-shaped flaps 66 and 67 the two legs of each of which are attached to the sole. The flaps 66 and 67 are also connected together by the front strap 60, clamp fastener 61 and connector elements 62 and 63. These flaps 66 and 67 serve to distribute tension to the sole from the front strap unit; they also distribute pressure to the upper front foot also as induced or exerted by the front strap unit. The flaps 66 and 67 may, however, as desired be dispensed with; if the flaps 66 and 67 are not present, then for example, the end 68 of the front strap may be attached directly to the sole; the connector 62 may be attached to the sole by a web member similar to web member 70; and the connector 63 may remain attached to the sole by the strap or web member 70.

Turning to FIGS. 11, 12, 13 and 14, these figures illustrate the clamp fastener 61 shown in FIG. 1 as well as the interaction of the clamp fastener 61 and the front strap 60; the clamp fastener 61 shown is of known structure. If desired the illustrated clamp fastener 61 may be replaced by any other (known) equivalent clamp type fastener. For example, the cam type of clamp fastener illustrated in U.S. Pat. No. 3,452,457, may be used provided that it is suitably modified to allow for attachment of the strap thereto for forming the required strap loop (see for example FIGS. 17 to 20); the entire contents of this patent is hereby incorporated herein by reference.

Referring to FIG. 11 the clamp fastener 61 has a shell 75 which defines a main opening. The fastener 61 includes a first clamp element 76, a displaceable clamp member 77 and a lever member 78 integral with the clamp member. When the clamp member 77 is in the non-operative position as shown in FIG. 11, the clamp element 76 and the clamp member 77 divide the main opening of shell 75 into three sub-openings 80, 81 and 82. The shell 75 has opposed side walls provided with side openings 83 and 84. The clamp element 76 is provided at both of its ends with elongated (e.g. rectangular like) lugs, one of which is designated in FIG. 11 with the reference numeral 85. The lugs 85 are sized and configured so as to be engaged in respective openings 83 and 84 such that the clamp element 76 is reciprocally displaceable in the direction as shown by the double headed arrow 87. The clamp member 77 has pivot pins 88 mounted at opposite ends thereof; the pivot pins are sized and configured to engage openings 89 such that the clamp member 77 may be pivoted or rotated by the lever member 78 between an operative and non-operative position as shall be described below.

FIG. 12 schematically illustrates the interconnection between the front strap 60 (strap 60 being shown simply as a line), the clamp fastener 61 and the first and second connector elements 62 and 63, the clamp member 77 being shown in FIGS. 11, 12 and 13 in the non-operative position; for illustration purposes, the clamp member 77 is shown only in dotted outline in FIG. 12. As may be seen, the front strap 60 is threaded in serpentine fashion through the openings 80 and 81 such that part of the strap 60 extends from one side of the clamp fastener and another part extends from the opposite side thereof.

One part of the front strap is formed into a first strap loop 90 of adjustable size. Thus one part of the front strap 60 which extends from the clamp fastener is slidingly threaded through the opening 65 of the connector 63 and the end thereof is attached to an end wall of the shell 75 by a small unadjustable loop 91 of the strap which is stitched in place by stitches 92. The other part of the front strap 60 which extends from the other side of the clamp fastener is formed into a V-shaped configuration comprising leg 95 and leg 96, the apex of the V-shaped configuration being located at the connector 62. Thus the other part of the front strap 60 which extends from the opposite side of the clamp fastener is slidingly threaded through the opening 64 of the connector 62 and the end 68 thereof is attached to the flap 67 by suitable stitching.

The openings 64 and 65 are configured and sized such that the strap 60 is slidingly engageable therein, i.e. similarly as the other openings which slidingly engage a strap.

Turning to FIG. 13, this figure is a longitudinal cross sectional view of the fastener shown in FIG. 11 but with the front strap 60 threaded therethrough as shown in FIG. 12. The clamp element 76 is provided with longitudinally extending rounded projections or detents 100 and 101. The opposed end wall of the shell 75 is also provided with longitudinally extending rounded projections or detents 102 and 103. The detents 100 and 102 are disposed opposite to each other; likewise the detents 101 and 103 are disposed opposite to each other. The clamp element 76 has a side surface 104 which conforms to the contour of the curved surface 105 of the clamp member 77. The opening 80 is present because the indents 100, 101, 102 and 103 are spaced apart sufficiently to define an opening through which the strap 60 may be threaded. Similarly, the opening 81 is present because the surface 104 is spaced sufficiently apart from the opposite structure of the displaceable clamp member 77 so as to allow the strap 60 to be threaded therethrough.

As mentioned above the clamp element 76 is reciprocally displaceable in the directions shown by the arrows 106 and 107. On the other hand the clamp member is pivotable or rotatable about a longitudinal axis 108 as shown by the arrows 109 and 110. The rotation of the displaceable clamp member 77 in the direction of the arrow 110 brings the clamp member to the non-operative position shown in FIG. 13 wherein the clamp fastener is not secured to the strap 60 since the openings 80 and 81 are present.

In order to displace the clamp member 77 to the operative position the clamp member 77 is rotated in the direction of the arrow 109. The distance 112 is such that when the clamp member 77 is rotated in the direction of the arrow 109, the tongue portion 113 of the clamp member defining the curved surface 105 urges the clamp element 76 in the direction of the arrow 107. The tongue portion 113 is spaced from the main body of the clamp member 77 by an elongated opening 114; the tongue portion 113 is relatively stiff but the end 115 thereof is able to flex somewhat into the opening 114 when in or moving from or to the operative position; the curved contour of the surface 105 allows the clamp member 77 to snap into place in the operative position.

Referring to FIG. 14, the clamp member 77 is shown in the operative position. As may be seen the opening 80 is closed off by the indents 100 to 103 which pinch into the strap 60; similarly the opening 81 is closed off by the surfaces 104 and 105 which sandwich the strap 60 between themselves. To release the clamp fastener from the strap 60 the lever 78 is gripped and pulled upwardly to rotate the clamp means in the direction of the arrow 110.

As may be noted the opening 82 remains open whether or not the clamp member is in the operative or non-operative position.

Thus in the non-operative position in FIG. 13, the fastener 61 may be slid or moved along the front strap 60 either towards the connector 63 to reduce the size of the loop 90 and increase the length of that part of the front strap defining the legs 95 and 96 so as to loosen the grip of the front strap on the foot, away from the connector 63 towards the connector 62 to increase the size of the loop 90 and decrease the length of that part of the front strap defining the legs 95 and 96 so as to tighten the grip of the front strap on the foot.

Tightening the front strap over the foot causes the flaps 66 and 67 to contract over the foot whereas loosening of the front strap causes the flaps to expand over the foot. For a front strap unit including the flaps as shown, the attachment point of the connector 62 to the flap 66, the attachment point of the end 68 to the flap 67 as well as the degree of permissible overlapping of the apex ends of the flaps are chosen so as to provide a predetermined amount of loosening and tightening about the foot before an apex end of a flap may abut against a connector 62 or the end 68 and thus limit further contraction of the flaps.

The straps, flaps and heel counters may be attached to the sole in any suitable known manner; see for example U.S. Pat. Nos. 5,056,241, 4,793,075, 3,323,233, 2,642,677 2,451, 372 and 2,377,119 the entire contents of which are incorporated herein by reference. Referring to FIG. 15 the straps, flaps, etc. may be curled under the insole so as to be sandwiched between the insole and outsole which may be attached together by a suitable adhesive or glue. FIG. 16 shows a partially cut away side view of the sandal shown in FIG. 1; the lower part 102 of the heel counter members is attached (e.g. by adhesive) to the peripheral edge of the sole and is covered by a flap element which in FIG. 16 is shown as removed to expose the lower part 120.

As shown in FIGS. 1 to 6 the sandal is also provided with an ankle sock 125 which is made of a suitable flexible, soft material for wearer comfort.

In accordance with the present invention the strap 12 may, for example, be of a leather like material; the strap 60 may be of a web of nylon material.

Turning to FIGS. 17 to 20, these figures illustrate a clamp fastener 61*a* which is a modified version of the clamp fastener 61 which is shown in FIGS. 11 to 15; thus, the same reference numerals are used in FIGS. 17 to 20 to designate the elements common with the clamp fastener 61.

The FIGS. 18 to 20 show the interaction of the clamp fastener 61*a* and the front strap 60 (strap 60 being shown simply as a line).

The clamp fastener 61*a* differs from the clamp fastener 61 in that the fastener 61*a* does not have a moveable first clamp element 76 nor does it define an opening 80 in the non-operative position; the shell 75 has opposed side walls with openings 89 but the shell 75 is not provided with side openings 83 and 84. Instead, the clamp fastener 61*a* has a first clamp element 130 which is integral with and fixed to the shell 75, the clamp element 130 defines the same side surface 104 referred to with respect to the fastener 61 (see FIGS. 13 and 14). The clamp fastener 61*a* does, however, have the openings 81 and 82 as well as the displaceable clamp member 77 referred to above with respect to the clamp fastener 61; accordingly, keeping in mind the mentioned differences between the fasteners 61 and 61*a*, the above description of the clamp fastener 61 in relation to FIGS. 11 to 14 applies in analogous fashion to the clamp fastener 61*a* in relation to FIGS. 17 to 20.

We claim:

1. A sandal of the type comprising a sole and a strap system for retaining said sole on a human foot, said human foot having a front part and a rear part, said sole having a front portion, a heel portion, and, opposed first and second side edges, said strap system comprising a front strap unit for securing the sandal to the front part of the human foot and an ankle strap unit for securing the sandal to the rear part of the human foot, characterized in that at least one of said strap units comprises a strap, a strap fastener and strap connector comprising an opening configured to receive said strap, said strap connector being attached to said first side edge of said sole, said strap fastener comprising first and second locking parts, said first and second locking parts being configured so as to be releasably interlockable, said first locking part comprising a ladder lock member, said ladder lock member comprising at least two openings for receiving said strap, said strap being attached to said second side edge of said sole and being threaded, in serpentine fashion, through at least two openings of said ladder lock member, said strap being attached to said second locking part and being threaded through the opening of said strap connector such that when the first and second locking parts are interlocked, the strap defines a strap loop threaded through the opening of said strap connector, said strap being configured so as to be threadable through said opening of the strap connector when the first and second locking parts are separated, said at least two openings of said ladder lock member being configured and disposed such that when the first and second locking parts are interlocked and the strap loop is longitudinally tensioned, the ladder lock member grasps the strap so as to secure the strap fastener to the strap and such that when the first and second locking parts are separated, the strap is threadable through said at least two openings of the ladder lock member for varying the size of said strap loop so as to thereby adjust the grasp of the strap to the foot.

2. A sandal of the type comprising a sole and a strap system for retaining said sole on a human foot, said human foot having a front part and a rear part, said sole having a front portion, a heel portion, and, opposed first and second side edges, said strap system comprising a front strap unit for securing the sandal to the front part of the human foot and an ankle strap unit for securing the sandal to the rear part of the human foot, characterized in that said ankle strap unit comprises a strap, a strap fastener and a strap connector comprising an opening configured to receive said strap, said strap connector being attached to said first side edge of said sole at said heel portion, said strap fastener comprising first and second locking parts, said first locking and second locking parts being configured so as to be releasably interlockable, said first locking part comprising a ladder lock member, said ladder lock member comprising at least two openings for receiving said strap, said strap being attached to said second side edge of said sole at said heel portion and being threaded, in serpentine fashion, through at least two openings of said ladder lock member, said strap being attached to said second locking part and being threaded through the opening of said strap connector such that when the first and second locking parts are interlocked, the strap defines a strap loop threaded through the opening of said strap connector, said strap being configured so as to be threadable through said opening of the strap connector when the first and second locking parts are separated, said at least two openings of said ladder lock member being configured and disposed such that when the first and second locking parts are interlocked and the strap loop is longitudinally tensioned, the ladder lock member grasps the strap so as to secure the strap fastener to the strap and such that when the first and second locking parts are separated, the strap is threadable through said at least two openings of the ladder lock member for varying the size of said strap loop so as to thereby adjust the grasp of the strap to the foot.

3. A sandal as defined in claim 2 wherein said strap is an instep strap.

4. A sandal as defined in claim 3 wherein said ankle strap unit includes a rear strap.

5. A sandal as defined in claim 3 wherein said ankle strap unit includes a rear strap and a heel counter, said heel counter comprising opposed first and second upstanding heel counter members attached to said sole at said rear heel portion, the first heel counter member being attached at said first side edge, the second heel counter member being attached at said second side edge, the first heel counter member defining said strap connector and said opening thereof for receiving said instep strap, said rear strap being attached to each of said heel counter members, said instep strap being threaded through the opening of said so defined strap counter and being attached to the second heel counter member.

6. A sandal as defined in claim 5 characterized in that said front strap unit is configured to extend transversely across said front part of the human foot, said front strap unit comprises a first connector, a second connector, a front strap, and a clamp fastener, said first and second connectors each comprising an opening configured to receive said front strap, said clamp fastener comprising a first clamp element and a displaceable clamp connected to lever, said first connector being attached to said first side edge of said sole at said front portion, said second connector being attached to said second side edge of said sole at said front portion, said clamp fastener being configured for clampingly engaging said front strap between said first clamp element and said displaceable clamp such that a part of the front strap extends from one side of the clamp fastener and another part of the front strap extends from another side of said clamp fastener, the part of the front strap extending from one side of the clamp fastener being threaded through the opening of said second connector and being attached to said clamp fastener so as to define a first strap loop, the part of the front strap extending from said another side of the clamp fastener being threaded through the opening of said first connector and being attached adjacent to said second side edge of the sole so as to define a V-shape strap configuration having an apex located at the opening of said first connector, said clamp means and said lever being configured such that the displaceable clamp is displaceable by the lever between an operative position wherein the front strap is clamped between said displaceable clamp and said first clamp element so as to secure the clamp fastener to the front strap and a non-operative position wherein the clamp fastener is released from the front strap for adjusting the size of said first strap loop and the length of said part of the front strap defining the V-shaped strap configuration so as to thereby adjust the grasp of the front strap unit to the foot said front strap being configured so as to be threadable through said opening of said first connector when the clamp fastener is released from the front strap, said front strap being configured so as to be threadable through said opening of the second connector when the clamp fastener is released from the front strap.

7. A sandal as defined in claim 2 characterized in that said front strap unit is configured to extend transversely across said front part of the human foot, said front strap unit comprises a first connector, a second connector, a front strap, and a clamp fastener, said first and second connectors each comprising an opening configured to receive said front strap, said clamp fastener comprising a first clamp element and a displaceable clamp connected to a lever, said first connector being attached to said first side edge of said sole at said front portion, said second connector being attached to said second side edge of said sole at said front portion, said clamp fastener being configured for clampingly engaging said front strap between said first clamp element and said displaceable clamp such that a part of the front strap extends from one side of the clamp fastener and another part of the front strap extends from another side of said clamp fastener, the part of the front strap extending from one side of the clamp fastener being threaded through the opening of said second connector and being attached to said clamp fastener so as to define a first strap loop, the part of the front strap extending from said another side of the clamp fastener being threaded through the opening of said first connector and being attached adjacent to said second side edge of the sole so as to define a V-shape strap configuration having an apex located at the opening of said first connector, said displaceable clamp and said lever being configured such that the displaceable clamp is displaceable by the lever between an operative position wherein the front strap is clamped between said displaceable clamp and said first clamp element so as to secure the clamp fastener to the front strap and a non-operative position wherein the clamp fastener is released from the front strap for adjusting the size of said first strap loop and the length of said part of the front strap defining the V-shaped strap configuration so as to thereby adjust the grasp of the front strap unit to the foot said front strap being configured so as to be threadable through said opening of said first counter when the clamp fastener is released from the front strap, said front strap being configured so as to be threadable through said opening of the second connector when the clamp fastener is released from the front strap.

* * * * *

UNITED STATES PATENT AND TRADEMARK OFFICE

CERTIFICATE OF CORRECTION

PATENT NO. : 5,465,506

DATED : November 14, 1995

INVENTOR(S) : Matis, et al.

It is certified that error appears in the above-indentified patent and that said Letters Patent is hereby corrected as shown below:

Claim 6, column 13, line 37, after "said" (1st. occ.) insert --displaceable --.

Claim 6, column 13, line 37, delete "means".

Claim 7, column 14, line 45, delete "counter" and insert --connector-- therefor.

Signed and Sealed this

Sixteenth Day of July, 1996

*Attest:*

Bruce Lehman

BRUCE LEHMAN

*Attesting Officer*

*Commissioner of Patents and Trademarks*